United States Patent [19]

Nakamura et al.

[11] Patent Number: 5,044,292

[45] Date of Patent: Sep. 3, 1991

[54] SEWING MACHINE WITH LOWER THREAD SUPPLY CONTROL MEANS

[75] Inventors: Takashi Nakamura; Haruhiko Tanaka; Akira Orii, all of Hachioji; Toru Hyodo, Sagamihara, all of Japan

[73] Assignee: Janome Sewing Machine Co., Ltd., Tokyo, Japan

[21] Appl. No.: 535,118

[22] Filed: Jun. 8, 1990

[30] Foreign Application Priority Data

Jun. 9, 1989 [JP] Japan ..... 1-145081

[51] Int. Cl.[5] ..... D05B 3/02; D05B 45/00

[52] U.S. Cl. ..... 112/453; 112/184; 112/278; 112/302

[58] Field of Search ..... 112/273, 278, 453, 302, 112/228, 231, 184

[56] References Cited

U.S. PATENT DOCUMENTS 3,738,296 6/1973 MacKenzie et al. ..... 112/273
4,237,807 12/1980 Meier et al. ..... 112/273 X
4,566,396 1/1986 Sakuma et al. ..... 112/278 X
4,934,292 6/1990 Mardix et al. ..... 112/273

FOREIGN PATENT DOCUMENTS 3625630 2/1988 Fed. Rep. of Germany ..... 112/278
0185293 8/1986 Japan ..... 112/278

*Primary Examiner*—Peter Nerbun
*Attorney, Agent, or Firm*—Dann, Dorfman, Herell and Skillman

[57] ABSTRACT

An amount of a lower thread to be supplied from a bobbin in each stitch forming operation is first determined on a theoretical basis in accordance with the stitch control data stored in a pattern memory. The sewing machine is provided with a bobbin rotation detector which detects every rotation of the bobbin to estimate a lower thread amount which has actually been supplied from the bobbin. A control unit compares the theoretical amount and the practical amount to lead out a correction coefficient which will be applied to the theoretical amount for the next stitch forming operation.

2 Claims, 13 Drawing Sheets

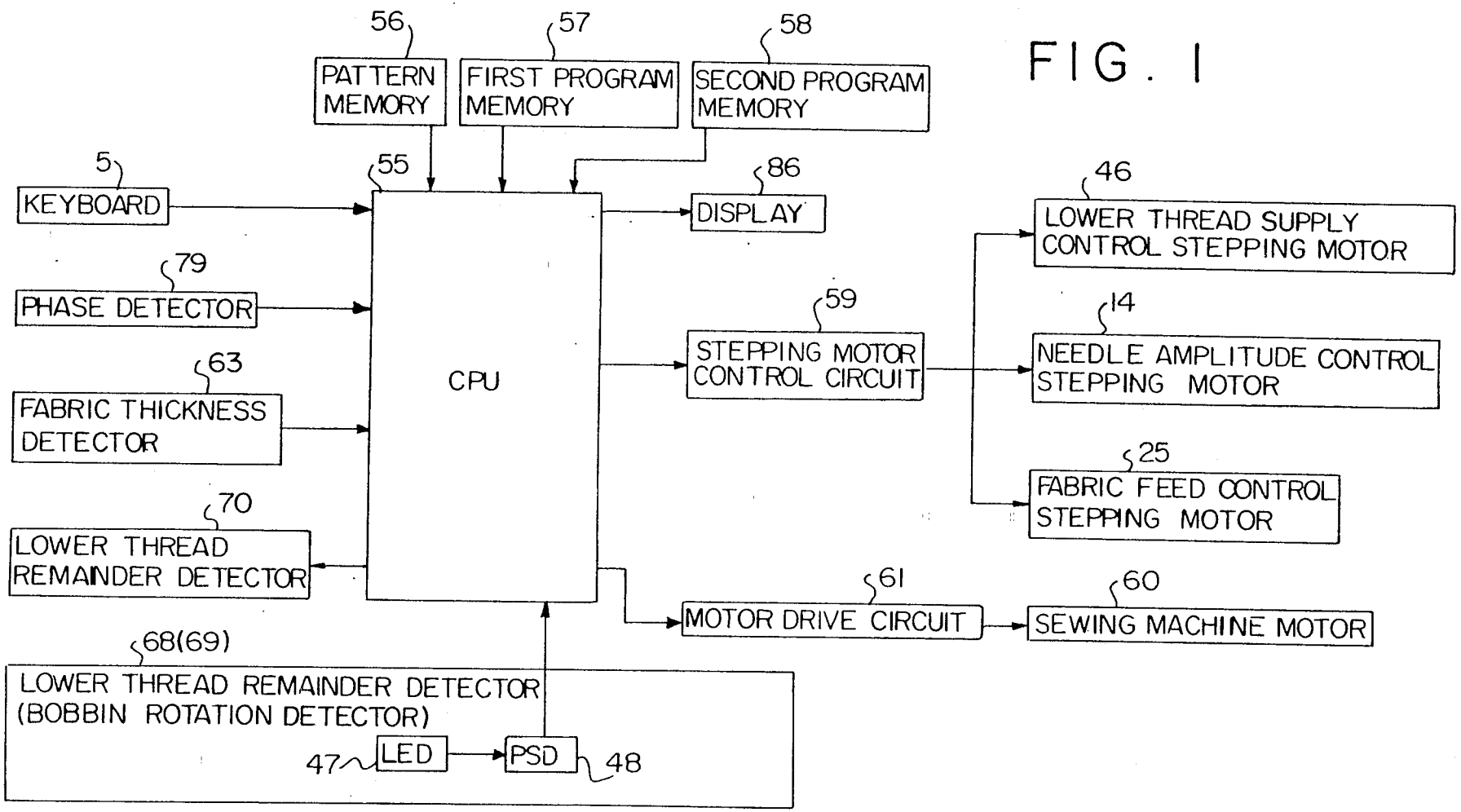
FIG. 1
46
LOWER THREAD SUPPLY CONTROL STEPPING MOTOR
14
NEEDLE AMPLITUDE CONTROL STEPPING MOTOR
25
FABRIC FEED CONTROL STEPPING MOTOR
60
SEWING MACHINE MOTOR
58
SECOND PROGRAM MEMORY
86
DISPLAY
59
STEPPING MOTOR CONTROL CIRCUIT
61
MOTOR DRIVE CIRCUIT
57
FIRST PROGRAM MEMORY
56
PATTERN MEMORY
55
CPU
48
PSD
47
LED
5
KEYBOARD
79
PHASE DETECTOR
63
FABRIC THICKNESS DETECTOR
70
LOWER THREAD REMAINDER DETECTOR
68(69)
LOWER THREAD REMAINDER DETECTOR (BOBBIN ROTATION DETECTOR)

SEWING MACHINE WITH LOWER THREAD SUPPLY CONTROL MEANS

BACKGROUND OF THE INVENTION

This invention relates to a sewing machine in general and more particularly to a control means used in combination with an electronically controlled sewing machine for controlling an amount of a lower thread to be supplied in each stitch forming operation.

With the conventional sewing machines, a stitch is formed on a fabric by interlocking an upper thread carried by a vertically reciprocating needle and a lower thread supplied from a lower thread bobbin rotatably contained in a bobbin case which is, in turn, contained at a standstill in a rotating loop-taker. The loop-taker is mounted below a needle plate having a needle penetrating hole and operated in synchronism with reciprocation of the needle to interlock the upper thread with the lower thread in a well known manner.

There has been proposed many types of lower thread supplying mechanisms. An amount of the lower thread to be supplied from the bobbin for producing each stitch is determined theoretically based on the stitch control data of the pattern to be produced, which are stored in a pattern memory and read out therefrom to be supplied to a microcomputer mounted in the sewing machine. The microcomputer processes the stitch control data to determine coordinates of each needle dropping point. The lower thread supplying amount will therefore be theoretically determined in accordance with a distance between the one and the next needle dropping points located at different coordinates which have thus been determined by the stitch control data. In some cases, a thickness of a fabric on which the pattern is to be produced is detected by a sensor means, so that the fabric thickness is also taken into consideration in determination of the lower thread supplying amount.

In actual sewing machine operation, however, it has often been found that the lower thread supplying amount which will be determined on a theoretical basis in the above-described manner would not reflect an amount of the lower thread to be actually required for producing a stitch. Such discrepancy may be caused by various fluctuation factors, including a tension of the upper thread used in combination with the lower thread, friction properties of the upper and lower threads, and a load of the lower thread supplying mechanism. If an optimum amount of the lower thread should not be supplied, there would result in a deformed stitch or other stitching troubles.

SUMMARY OF THE INVENTION

It is therefore an object of the invention to provide a control means used in combination with an electronic sewing machine for definitely controlling an amount of the lower thread to be supplied in each stitching operation.

According to an aspect of the invention there is provided a sewing machine having a vertically reciprocating needle carrying an upper thread; a rotatable bobbin carrying a lower thread; and a loop-taker means operated in synchronism with reciprocation of the needle to interlock the upper thread with the lower thread to form a stitch; which further comprises a memory means for storing stitch control data of a plurality of patterns which may be produced with the sewing machine; a calculation means for theoretically determining an amount of the lower thread to be supplied from the bobbin in formation of each stitch, in accordance with the stitch control data of a specific pattern to be produced; a detection means for detecting an amount of the lower thread which has actually been supplied from the bobbin in formation of each stitch; and a control means for comparing the theoretical amount determined by the calculation means and the practical amount determined by the detection means to thereby lead out a correction coefficient to be used for correcting the theoretical amount of the lower thread to an optimum amount by which the lower thread is supplied from the bobbin to produce the next stitch.

BRIEF DESCRIPTION OF ACCOMPANYING DRAWINGS

Further objects and advantages of the invention can be understood from the following detailed description when read in conjunction with the accompanying drawings in which:

FIG. 1 is a block diagram showing control operation of the sewing machine embodying the invention;

Figure 19:
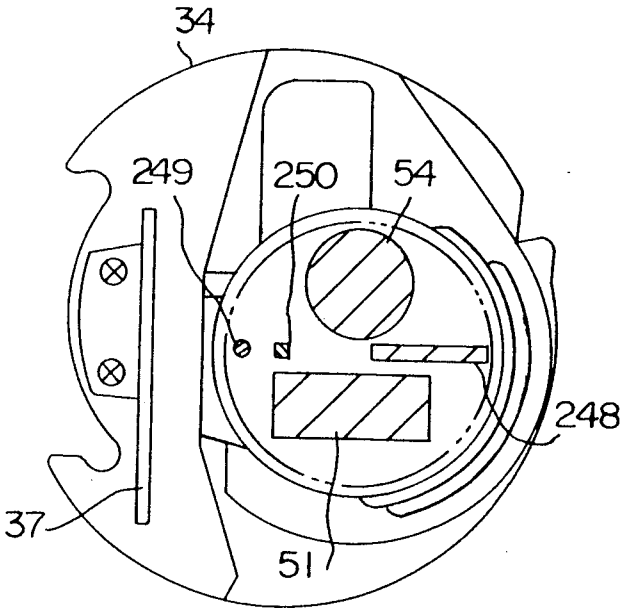
FIG. 18 and FIG. 19 are cross section and front view of a still modified embodiment of the invention.
Figure 18:
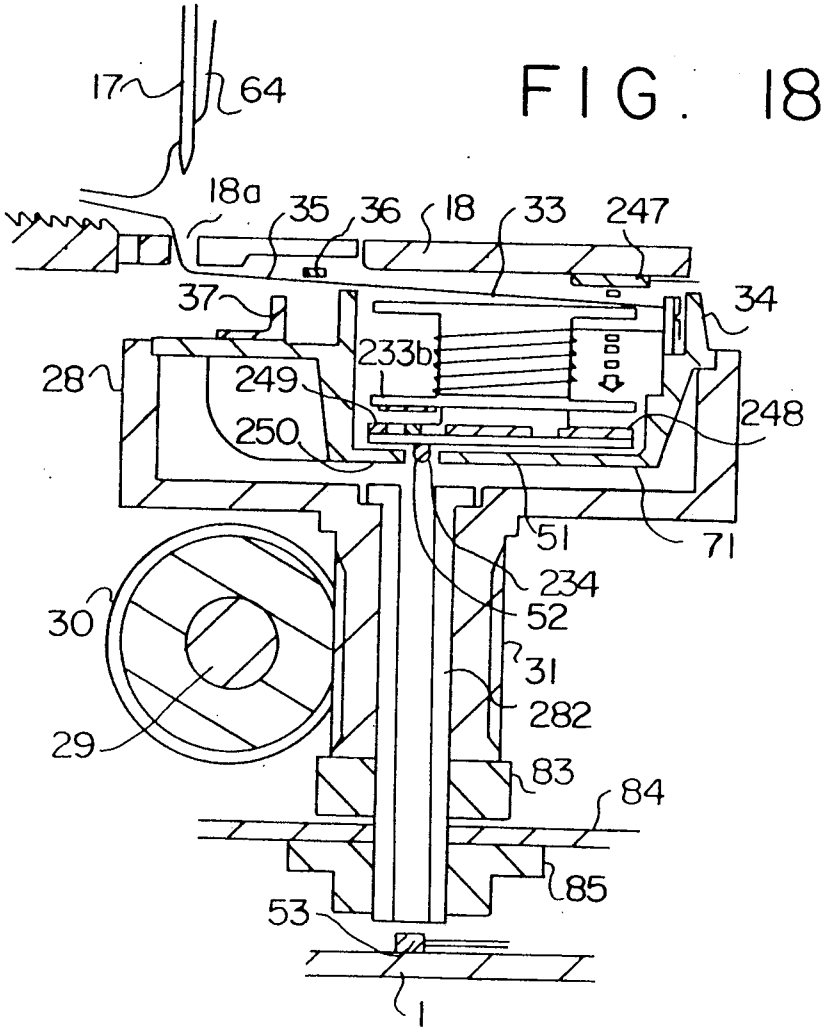
Figure 22:
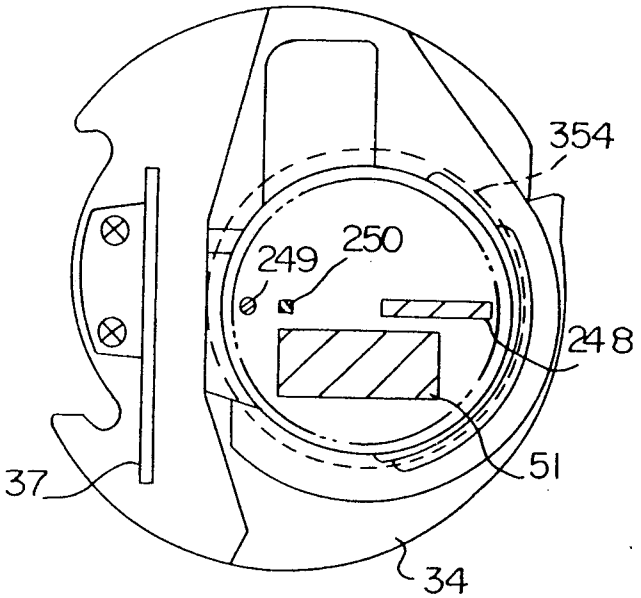
Figure 21:
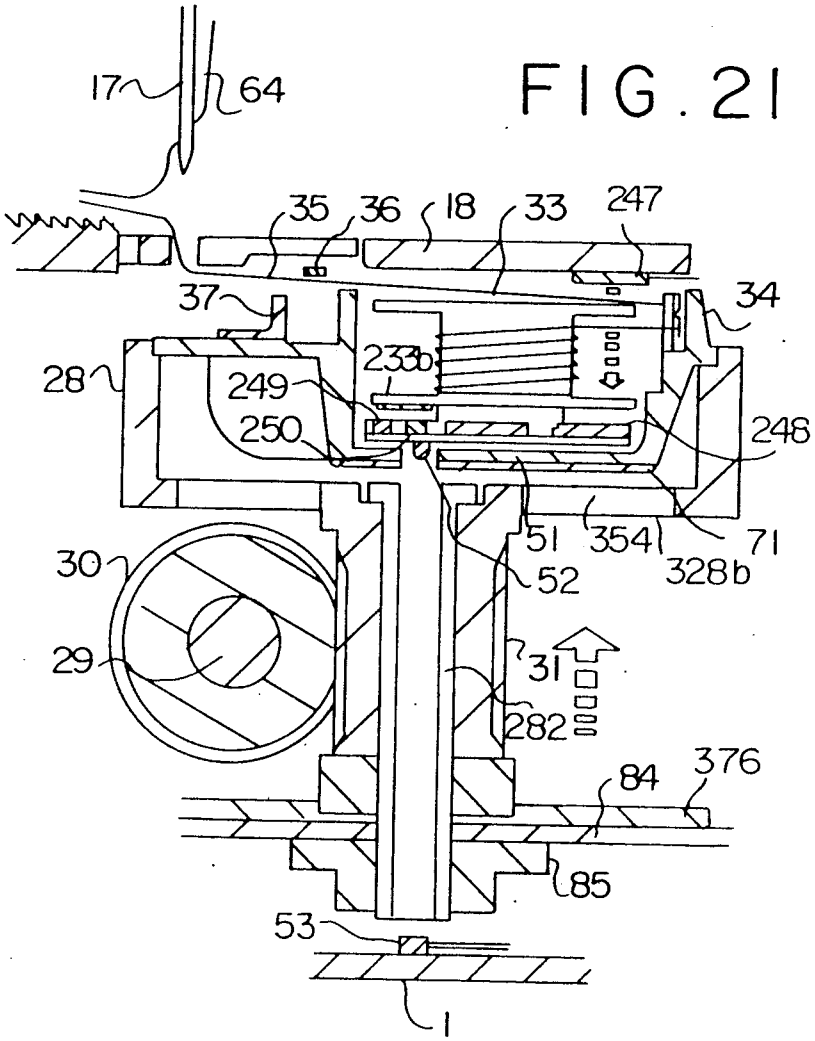
Figure 24:
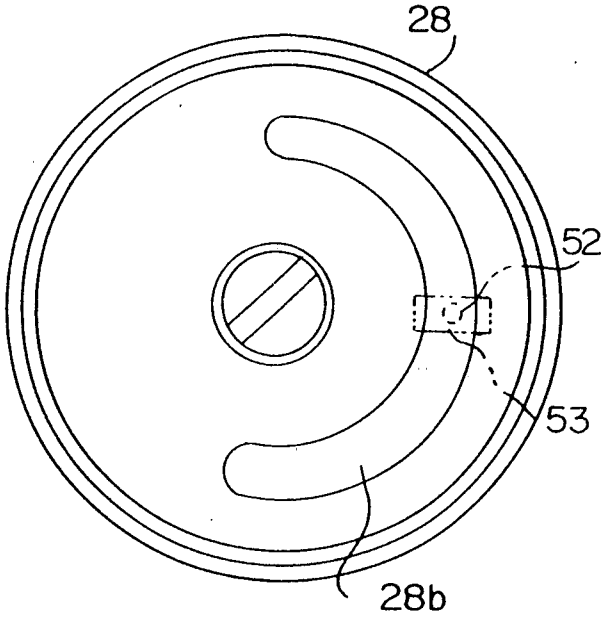
Figure 23:
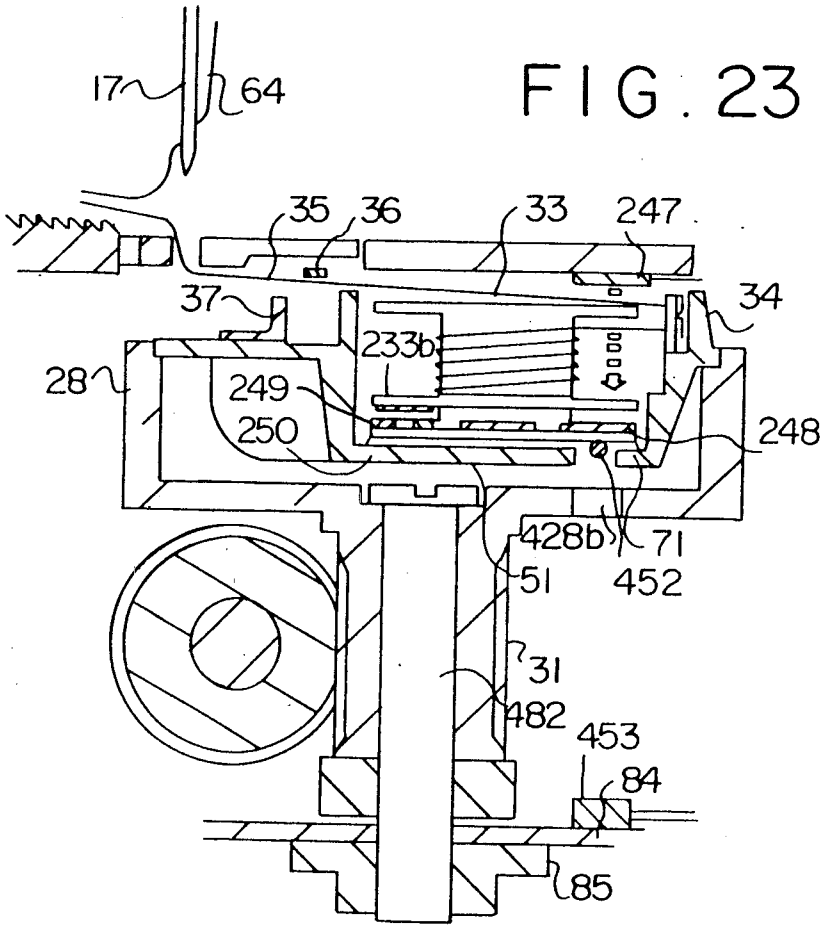

FIGS. 21 and 22 are cross section and front view of another embodiment which is only partly modified from the embodiment shown in FIGS. 18 and 19; and FIGS. 23 and 24 are cross section and front views, respectively, of still another embodiment which is only partly modified from the embodiment shown in FIGS. 18 and 19.

DESCRIPTION OF PREFERRED EMBODIMENTS

Figure 2:
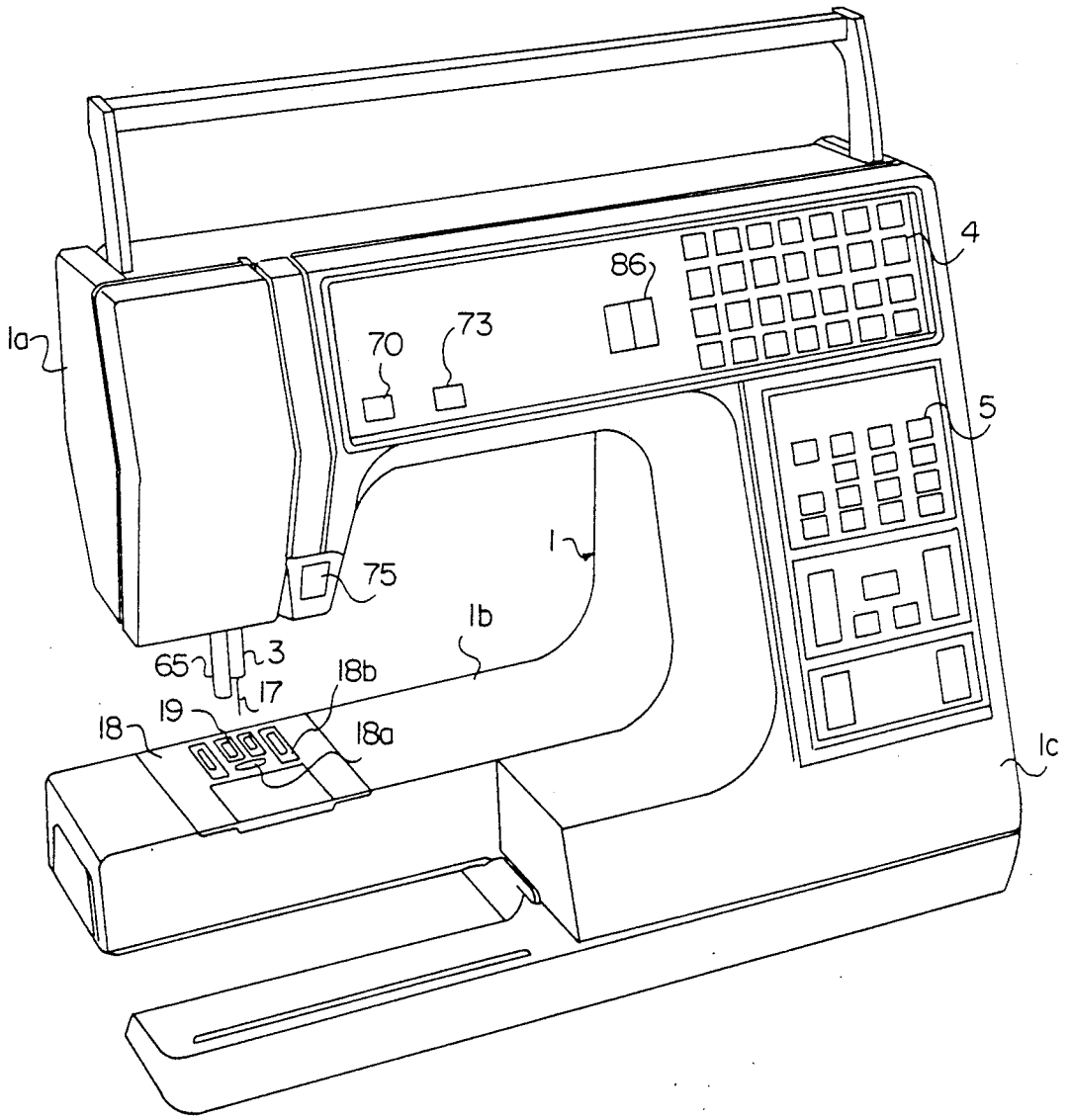
FIG. 2 is an perspective view showing an appearance of the sewing machine.
Figure 3:
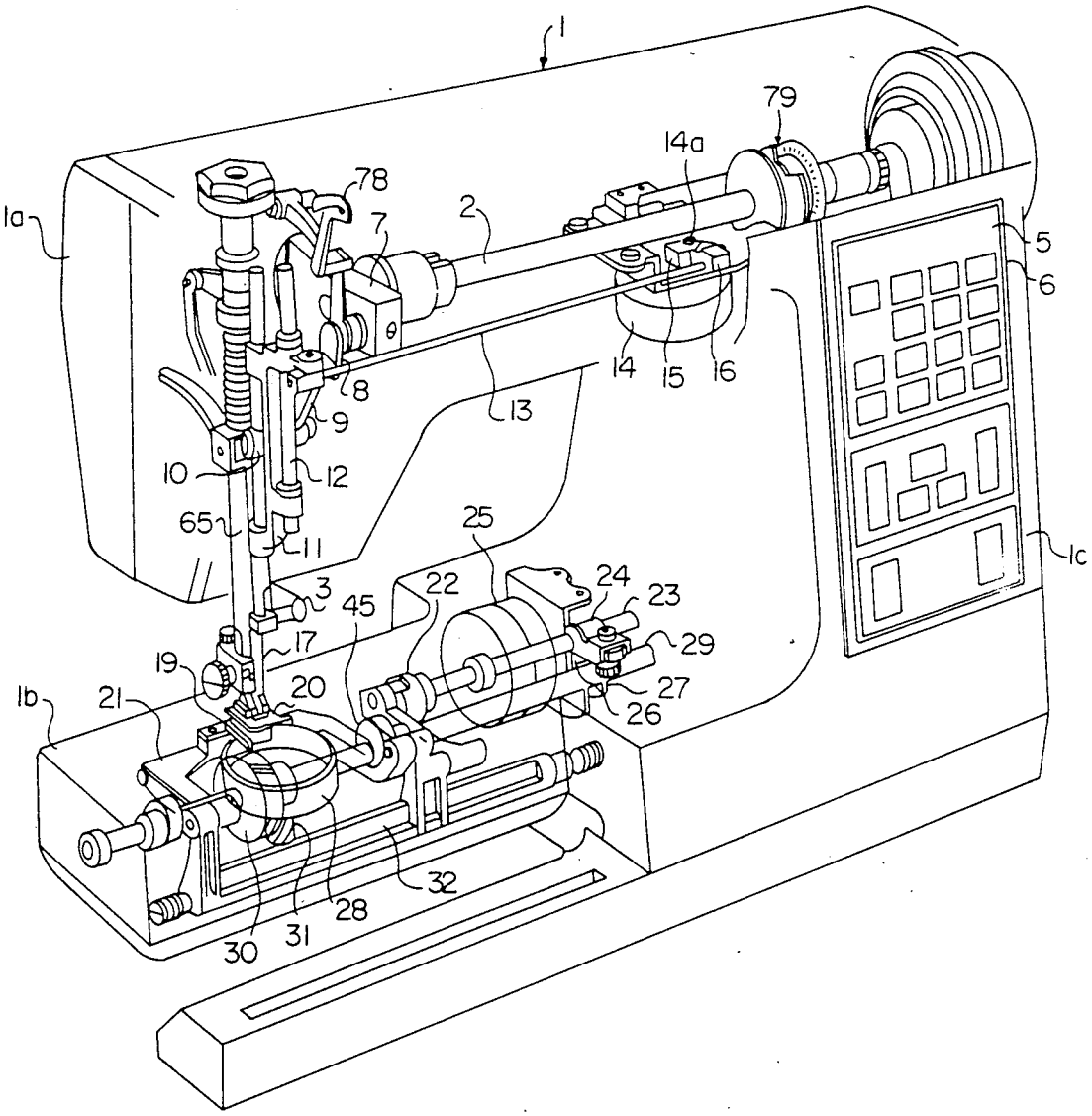
FIG. 3 is an perspective view, partly in broken, showing mechanical construction of the sewing machine.

At first, a general appearance and construction of an electronic sewing machine embodying the invention will be described in reference to FIGS. 2 and 3. A display 4 is provided on a front side of a horizontally extending arm 1*a* of a machine housing 1 for representing a stitch pattern which can be produced with the sewing machine and its pattern number. A keyboard panel 5 is provided on a neck portion 1*c* of the housing 1. The keyboard panel 5 includes ten-key buttons 6 operated to designate a selected one of the pattern numbers. The selected pattern number is represented on a display 86. The display 86 may represent a selected pattern itself by means of an LCD (liquid crystal display).

Figure 13:
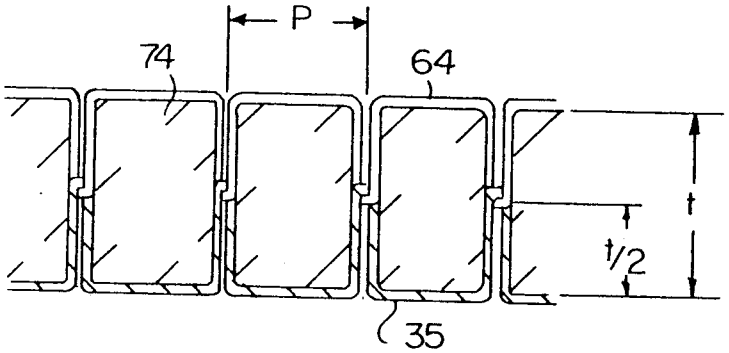
FIG. 12 and FIG. 13 are explanatory view showing a manner of determination of a lower thread supplying amount on a theoretical basis.

A main drive shaft 2 driven by an electromotor 60 (FIG. 1) is rotatably supported within the housing arm 1*a*. A needle bar 3 is supported by the housing 1 while being allowed to reciprocate up and down and swing in a lateral direction perpendicular to a fabric feeding direction. The needle bar 3 is connected to the main drive shaft 2 so that reciprocation of the former is synchronized with rotation of the latter. The needle bar 3 is provided at the tip end with a needle 17 carrying a needle thread or an upper thread 64 (FIG. 13). A bed 1*b* of the housing 1 extends substantially in parallel with the arm 1*a*, on which a needle plate 18 is detachably fitted in opposition to the needle 17. The needle plate 18 includes a needle hole 18*a* for allowing the needle 17 to pass therethrough. Below the needle plate 18 there is provided a loop-taker means 28 driven by a lower drive shaft 29 to rotate in synchronism with reciprocation of the needle 17 for interlocking the upper and lower threads to form a stitch on the fabric in a conventional manner. The needle plate 18 is also provided with a pair of elongated grooves 18*b* extending in parallel with the fabric feeding direction, through which a feed dog 19 may be exposed and elevated to above the needle plate 18.

The needle bar 3 is connected to the main drive shaft 2 which is, in turn, connected to the electromotor and extend substantially horizontally within the arm 1*a*. Rotation of the main drive shaft 2 is duly transmitted to the needle bar 3 through a known crank mechanism. More particularly, a crank arm 7 is secured to one end of the main drive shaft 2 and rotated therewith. A crank rod 9 is rotatably connected between a crank pin 8 secured near a peripheral edge of the crank arm 7 and a vertically extending rod 10 secured to the needle bar 3. The needle bar 3 is reciprocatably supported by a holder 11 which is, in turn, swingably supported by a stationary bar 12 secured to the sewing machine arm 1*a*. With the construction described above, during one rotation of the main drive shaft 2, the needle bar 3 resting at the upper dead point is moved down to the lower dead point and then elevated and returned to the upper dead point. Also, the needle bar 3 is swingable within a predetermined amplitude along with reciprocation of a horizontally extending rod 13 connected between the holder 11 and a link 16. The link 16 is secured to an arm 15 which is caused to swing by gear engagement with an output shaft 14*a* of a needle amplitude control stepping motor 14 mounted in the machine housing 1. Such arrangement for swinging the needle 17 is well known and will therefore need not be described in more detail.

The feed dog 19 for feeding the fabric is secured on an arm 21, which is, in turn, connected to a rod 32 driven by the main drive shaft 2. An amount of the fabric to be fed by the feed dog 19 will be determined by a rotational angle of an adjuster 22 which cooperates with an eccentric cam 45 secured to the lower drive shaft 29, in a conventionally known manner. The adjustor 22 is secured to one end of a rotating shaft 23. To the other end of the shaft 23 is connected an arm 24 which is, in turn, connected through a link 27 to a crank 26 secured to an output shaft of a fabric feed control stepping motor 25.

Figure 6:
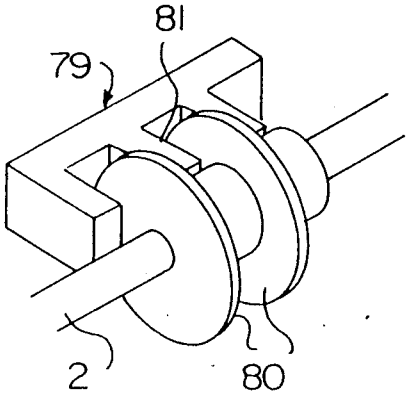
FIG. 6 is an enlarged perspective view of a phase detector.

A rotational angle or phase of the main drive shaft 2, which also governs a vertical position of the needle 17, will be detected by a phase detector 79 which comprises a pair of discs 80 secured to the main drive shaft 2 and a photo-interrupter 81 secured to the machine housing 1, as shown in FIG. 6.

The loop-taker 28 is mounted in the machine bed 1*b*. The rotation of the lower drive shaft 29 is duly transmitted to the loop-taker 28 via a gear 30 secured to the shaft 29 and a threaded shaft 31 of the loop-taker 28. A presser foot 20 is attached to the lower end of a vertically displaceable presser bar 65. When the presser bar 65 is lowered, the presser foot 20 will exert a downward pressure onto the fabric placed on the needle plate 18 and cooperate with the feed dog 19 to feed the fabric by a certain amount.

Figure 4:
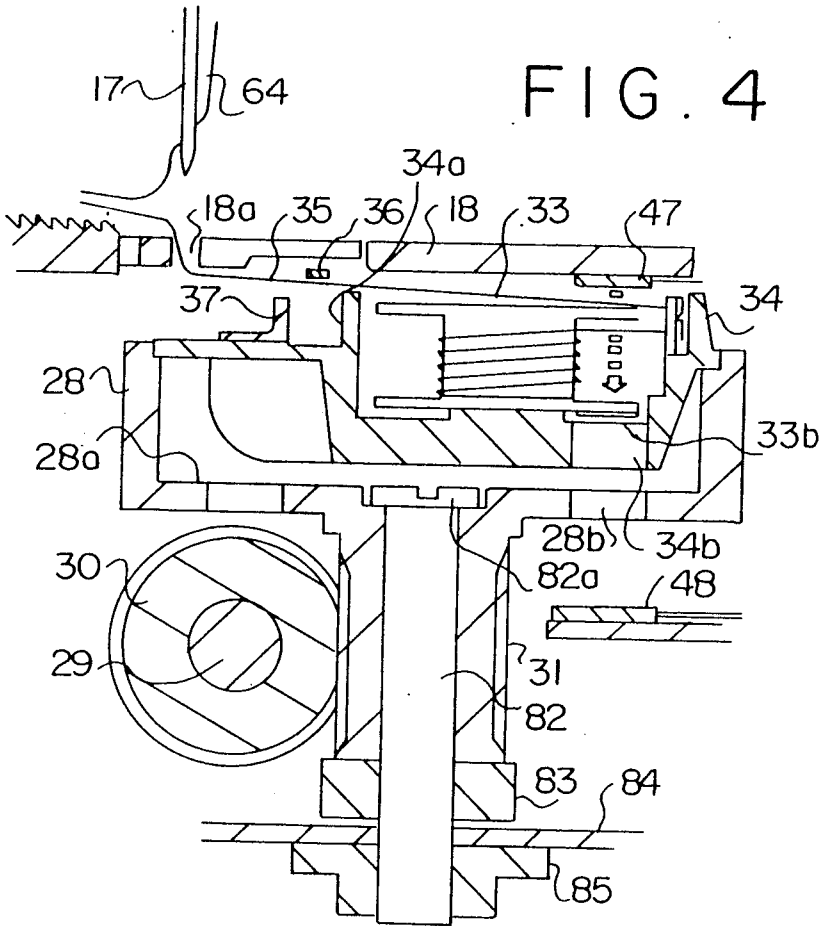
FIG. 4 is an enlarged cross section showing in particular essential features of the invention together with their associated elements in the sewing machine.

In further reference to FIG. 4, the shaft 31 formed integral with the loop-taker 28 is rotatably fitted around a stationary shaft 82. A top flange 82*a* of the shaft 82 and a bearing 83 secured to the shaft 82 cooperate with each other to prevent axial displacement of the shaft 31 and therefore of the loop-taker 28. The shaft 82 is secured to and extend through an attachment plate 84, which is secured to the housing 1, and a mount base 85 secured below the plate 84.

Figure 8:
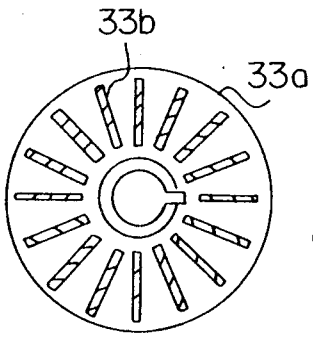
FIG. 7 and FIG. 8 are enlarged front and plan views of a bobbin.
Figure 7:
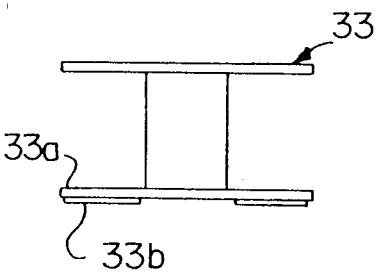

A bobbin case 34 is loosely received in the loop-taker 28 but remains standstill due to engagement with stop means (not shown) secured to the machine housing 1. A lower thread 35 is wound around a bobbin 33 rotatably contained in the bobbin case 34 and may be drawn out of the bobbin 33 by a lower thread supplying device to be described hereinlater. As known, the lower thread 35 will be given a predetermined degree of tension while being drawn out of the bobbin 33. The lower thread tension may be adjusted as desired by suitable adjustment means (not shown). A partition wall 37 is secured to the bobbin case 34 and extends in parallel with a straight extending portion 34*a* of a pheripheral wall of the bobbin case 34. The bobbin 33 is made from a transparent material. As shown in FIGS. 7 and 8, a plurality of radially extending photo-impermeable reflectors 33*b* are attached with an even angular interval onto a lower brim 33*a* of the bobbin 33.

Figures 9, 10:
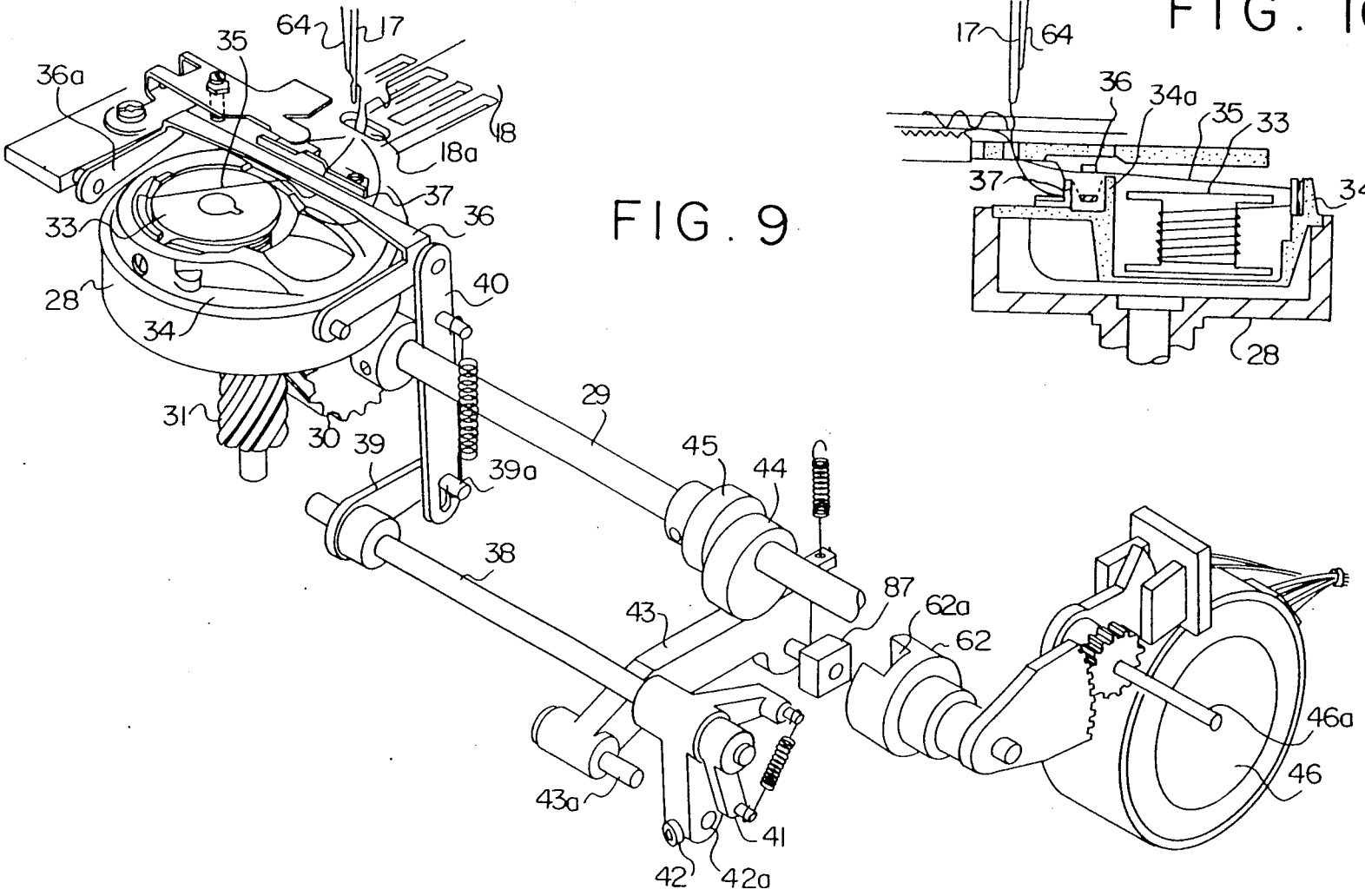
FIG. 9 is an enlarged perspective view showing in particular a lower thread supplying mechanism.
FIG. 10 is an enlarged cross section of a part of the lower thread supplying mechanism.

A lower thread 35 is drawn out of the bobbin 33 and supplied through the needle hole 18*a* to be interlocked with the upper thread carried by the needle 17. The lower thread supplying device operating for this purpose is particularly shown in FIG. 9 and FIG. 10. A rotatable arm 36*a* carries a horizontally extending bar 36 which may be inserted into a space (FIG. 4) between the partition wall 37 and the straight wall 34*a*. A rod 40 is connected between one end of the arm 36*a* and a leading end pin 39*a* of an operating arm 39. The operating arm 39 is secured at the other end thereof to a shaft 38 which is rotatable but not displaceable in any direction. A first link 41 is fixedly connected to the other end of the shaft 38. A second link 42 is also connected to the shaft 38 in engagement with the first link 41 but rotatable around the shaft 38. The second link 42 is provided with a hole 42*a* for rotatably accommodating a projecting pin 43*a* of a link arm 43. The link arm 43 is always in contact with a cam 44 secured to the lower drive shaft 29. A square piece 87 secured to the link arm 43 is engaged within an arcuate groove 62*a* of an adjustor 62.

The adjustor 62 is connected to an output shaft 46a of a lower thread supply control stepping motor 46 so that an inclination angle of the groove 62a may be adjusted by driving the stepping motor 46 as desired.

With the foregoing arrangement, the link arm 43 is swung due to contact with the cam 44, which at last moves the press bar 36 up and down through the second link 42, the shaft 38, the operating arm 39 and the rod 40, in synchronism with reciprocation of the needle 17. It will be appreciated from FIG. 10 that when the press bar 36 descends to cooperate with the partition wall 37 and the wall 34a of the bobbin case 34, a certain amount of the lower thread 35 is drawn out of the bobbin 33. An amount of the lower thread 35 which will actually be drawn out of the bobbin 33 depends upon a descending stroke of the press bar 36 which, in turn, may be adjusted by operation of the stepping motor 46. Arrangement and operation of the lower thread supplying device employed in this embodiment is described in more detail in U.S. Ser. No. 07/307,388, now U.S. Pat. No. 4,938,158 filed on Feb. 6, 1989, assigned to the same assignee as the present invention.

Figure 5:
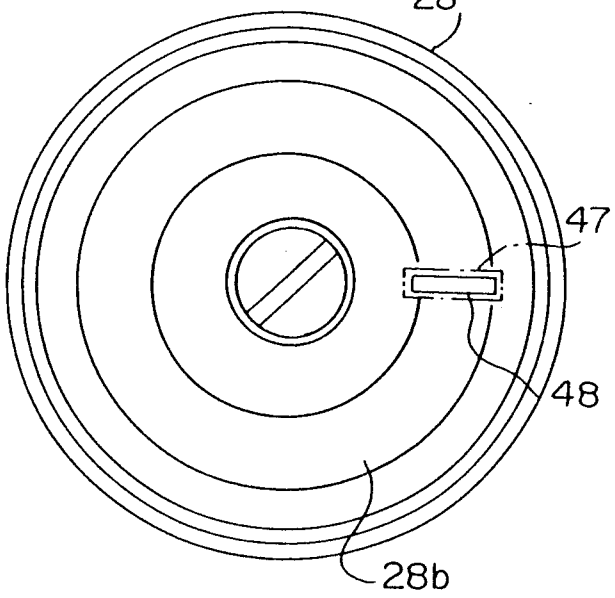
FIG. 5 is an enlarged plan view of a loop-taker.

Referring now specifically to FIGS. 4 and 5, a light emitting element 47 such as a light emitting diode (LED) is provided on a backside of the needle plate 18 in a position capable of radiating a light toward the radially extending brim portion of the bobbin 33. The light radiating from LED 47 passes through the transparent upper brim to reach the lower brim 33a (FIGS. 7 and 8) which will intermittenly pass through the light while the bobbin 33 is rotating. The light passing through the transparent portion (not provided with the photo-impermeable reflector 33b) of the lower brim 33a will then pass through a hollow space 34b formed in the bobbin case 34 and a ring plate 28b of a transparent resin material fitted in a bottom 28a of the loop-taker 28 to be finally received by a light receiving element 48 such as a PSD (position-sensitive detector) arranged in opposition to LED 47. PSD 48 generates a voltage output of a value which is proportional to an area radiated by the light emitting from LED 47. The area of radiation detected by PSD 48 will increase with consumption of the lower thread 35 in the bobbin 33, which means that PSD will operate as means for detecting a lower thread remainder. Due to provision of the photo-impermeable reflectors 33b on the lower brim 33a of the bobbin 33, the voltage output of PSD 48 will be obtained intermittently as a pulse signal which is usable for detection of every rotation of the bobbin 33.

Figure 11:
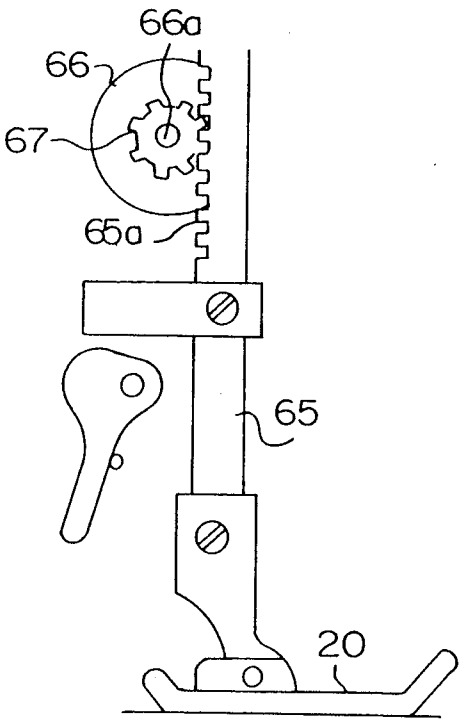
FIG. 11 is an enlarged view showing a fabric thickness detector.

FIG. 11 shows arrangement of a fabric thickness detector 63. As hereinbefore described, the presser bar 65 carrying the presser foot 20 is supported by the housing 1 to be movable up and down. The presser bar 65 is provided at an upper portion thereof a rack 65a engageable with a pinion gear 67 secured to a shaft 66a of an encoder 66. An output of the encoder 66 will be varied with the vertical position of the presser bar 65 which, in turn, corresponds to the fabric thickness.

Control operation of the electronic sewing machine will now be described in reference to FIG. 1. There is provided within the housing 1 a central processing unit (CPU) 55 to which is the keyboard 5, the pattern display 86, the main drive shaft phase detector 79 and the fabric thickness detector 63 are respectively connected. The lower thread remainder detector 68 and the bobbin rotation detector 69, both working by cooperation of LED 47 and PSD 48, are also connected to CPU 55.

A pattern memory 56 will store data, comprising stitch control data and display data, of a plurality of patterns or characters which may be produced on the fabric with the sewing machine. When a specific one of the patterns or characters is designated by operation of the keyboard 5 to designate a pattern number thereof, the stored data thereof is read out from the memory 56 to be transferred to CPU 55, which controls the display 86 to represent its pattern number or its pattern configuration based on the display data.

Figure 12:
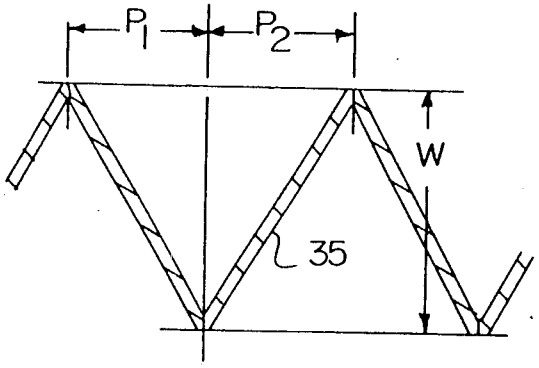
Figure 14:
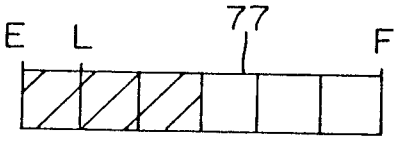
FIG. 14 is an explanatory view showing a level meter indicating a lower thread remainder.

First and second program memories 57 and 58 are connected to CPU 55. The first program memory 57 stores a program for determining coordinates of each needle dropping point to produce stitches of the selected pattern based on the stitch control data thereof. The second program memory 58 stores a program for theoretically determining a lower thread supplying amount to be required for producing each stitch of the selected pattern, based on the coordinates determined by the program stored in the first memory 57, to which is also incorporated the fabric thickness detected by the thickness detector 63. More particularly, the theoretical amount of the lower thread to be supplied for connecting two coordinates of the needle dropping points will be a three-dimensionally determined by a distance between the coordinates determined by the needle amplitude W and the feeding amount P, and also by the thickness t of the fabric 74, as can be seen in FIGS. 12 and 13. The second program memory 58 also stores another program for determining a practical lower thread supplying amount in each stitch, based on the pulse signal outputted from the bobbin rotation detector 69. The second program memory 58 also stores a correction program for comparing the theoretical amount and the practical amount to determine a correction coefficient to be described later in detail. A predetermined lower limit of the lower thread remainder in the bobbin 33 is also stored in the second program memory 58, which will be compared to the volume change signal outputted from the lower thread remainder detector 68.

An alarm means 70 comprising an LED, for example, is arranged on the front panel of the machine housing 1. LED 70 is lightened when CPU 55 discriminates that the lower thread amount remaining in the bobbin 33 decreased below the predetermined lower limit stored in the second program memory 58.

The stitch control data read out from the pattern memory 56 and the data obtained by the programs stored in the first and second program memories 57 and 58 will be processed by CPU 55 to control a stepping motor drive circuit 59 and a motor drive circuit 61. The needle amplitude control stepping motor 14, the fabric feed control stepping motor 25 and the lower thread supply control stepping motor 46 are driven under control by the drive circuit 59. The sewing machine motor 60 is driven under control by the drive circuit 61.

The electronic sewing machine will operate as follows. After the sewing machine has been energized, the keyboard 5 is so manipulated as to designate a selective one of the patterns so that the stitch control data and the display data of the selected pattern are read out from the pattern memory 56. In response to the display data, CPU 55 will act on the display 86 so that the pattern number of the selected pattern is indicated in the display 86. At the same time, CPU 55 will determine the coordinates of each needle dropping point, in response to the detection signal supplied from the fabric thickness detector 63 and in accordance with the program which is read out from the first program memory 57 to be applied to the stitch control data of the selected pattern. Further, in accordance with the program which is read out from the second program memory 58 to be applied to the coordinates of each needle dropping point which has thus been determined, CPU 55 will determine the theoretical lower thread supplying amount in such a manner as described before.

Then, a start button 75 (FIG. 2) is depressed to make operative the motor drive circuit 61 to drive the sewing machine motor 60.

While the main drive shaft 2 is being driven to rotate by the sewing machine motor 60, the rotational phase of the main drive shaft 2 is substantially continuously detected by the phase detector 79. CPU 55 will operate in response to the phase detection signal outputted from the phase detector 79 to drive under control the stepping motor drive circuit 59, thereby controlling the respective stepping motors 14, 25 and 46. The lower thread supply control stepping motor 46 is controlled such that the angular position of the adjustor 62 is adjusted so as to control the descending stroke of the press bar 36. The needle amplitude control stepping motor 14 and the fabric feed control stepping motor 25 are respectively controlled, in cooperation with the descending stroke of the press bar 36 controlled by the lower thread supply control stepping motor 46, so as to supply the theoretical amount of the lower thread 35 from the bobbin 33. The first stitch will thus be produced based on the theoretical lower thread supplying amount.

The lower thread 35 will be drawn out of the bobbin 33 twice during one rotation of the main drive shaft 2. More particularly, while the upper thread 64 which has been interlocked with the lower thread 35 by means of the loop-taker 28 is being drawn from below the needle plate 19 by ascending movement of a thread take-up lever 78 (FIG. 3) during the rotational phase of the main drive shaft 2 of 0° (at which the needle 17 stands in the upper dead point) to about 60° (at which the lever 78 stands in the upper dead point), some amount of the lower thread 35 will be drawn out of the bobbin 33. Then, during the rotational phase of the main drive shaft 2 of about 80° to 180° (the lower dead point of the needle 17), a substantial amount of the lower thread 35 will again be drawn out of the bobbin 33 by descending movement of the press bar 36. Thus, the lower thread 35 will be drawn substantially during the rotational phase of 0° to 180°. The amount of the lower thread 35 which has actually been supplied from the bobbin 33 during formation of the first stitch of the selected pattern may be calculated by CPU 55 in accordance with the detection pulse signal outputted from the bobbin rotation detector 69. The detection signal is outputted from the detector 69 while no lower thread supplying operation is carried out, i.e. between the rotational phase of the main drive shaft 2 of 180° and 360° (0°).

CPU 55 will compare the theoretical amount and the actual amount of the lower thread in accordance with the correction program stored in the second program memory 58 to determine the correction coefficient.

The second stitch of the selected pattern will be produced while the lower thread 35 is being supplied from the bobbin 33 by an amount which is first determined theoretically based on the coordinates of the second needle dropping point, which is then amended with the correction coefficient. Determination and amendment of the amount of the lower thread 35 to be supplied from the bobbin 33 will be carried out in CPU 55 before the lower thread 35 is drawn out of the bobbin 33 by descending movement of the lever 36, that is before the rotational phase of about 80°. Based on the lower thread supplying amount thus determined and amended, the stepping motor 46 is driven under control by CPU 55 via the drive circuit 59 to adjust the angular position of the adjustor 62.

The lower thread supplying amount will be determined in the same manner during the succeeding stitch forming operation. Thus, an optimum amount of the lower thread may be supplied for producing each stitch of the selected pattern.

The amount of the lower thread 35 remaining on the bobbin 33 is substantially continuously detected by the remainder detector 68 which outputs the detection signal to CPU 55. When the lower thread remainder becomes lower than the predetermined limit stored in the second program memory 58, CPU 55 will outputs a command signal to the alarm 70 so that LED is lightened or flashed to call the operator's attention to replenish the bobbin 33 with a supplemental amount of the lower thread 35.

The lower thread remainder may be continuously represented in a level meter 77 indicating a full level (F), a lower limit level (L) which calls for sooner replenishment of the lower thread and an empty level (E) requiring immediate replenishment. A lightened area of an LED will be decreased with consumption of the lower thread 35.

Figure 16:
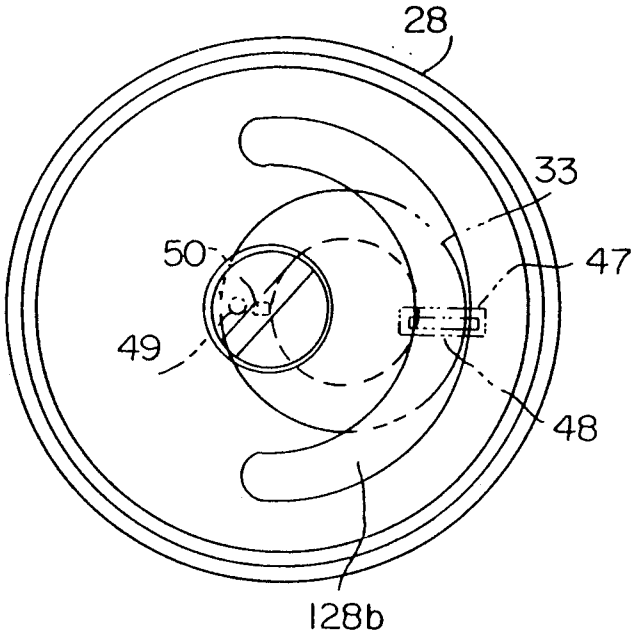
FIG. 15 and FIG. 16 are cross section and front view of a modified embodiment of the invention.
Figure 15:
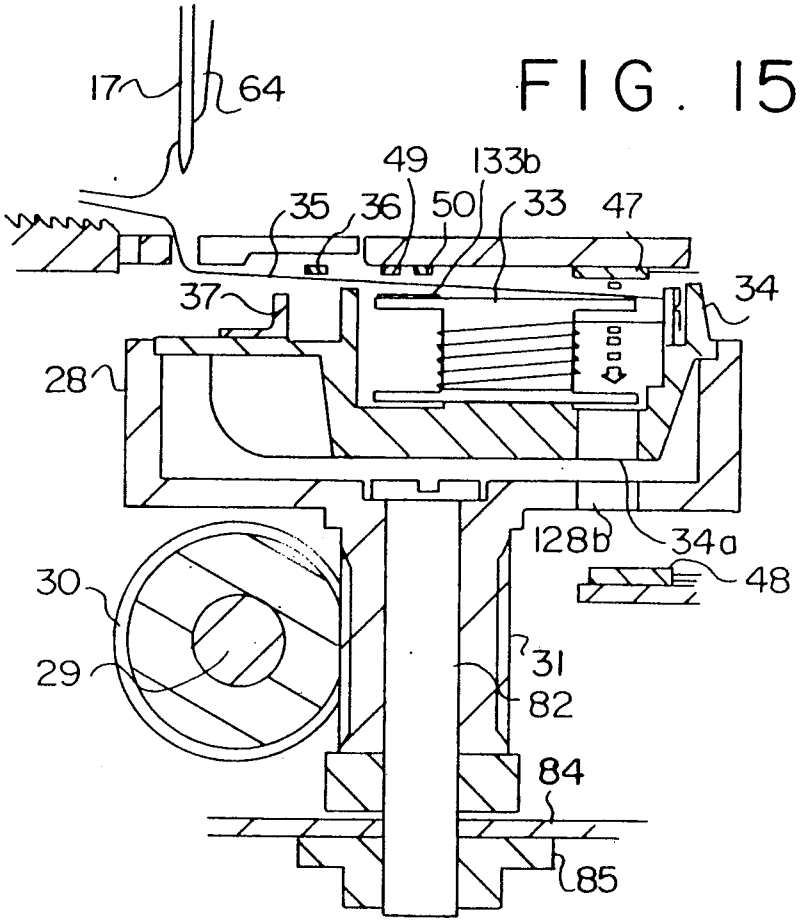
Figure 17:
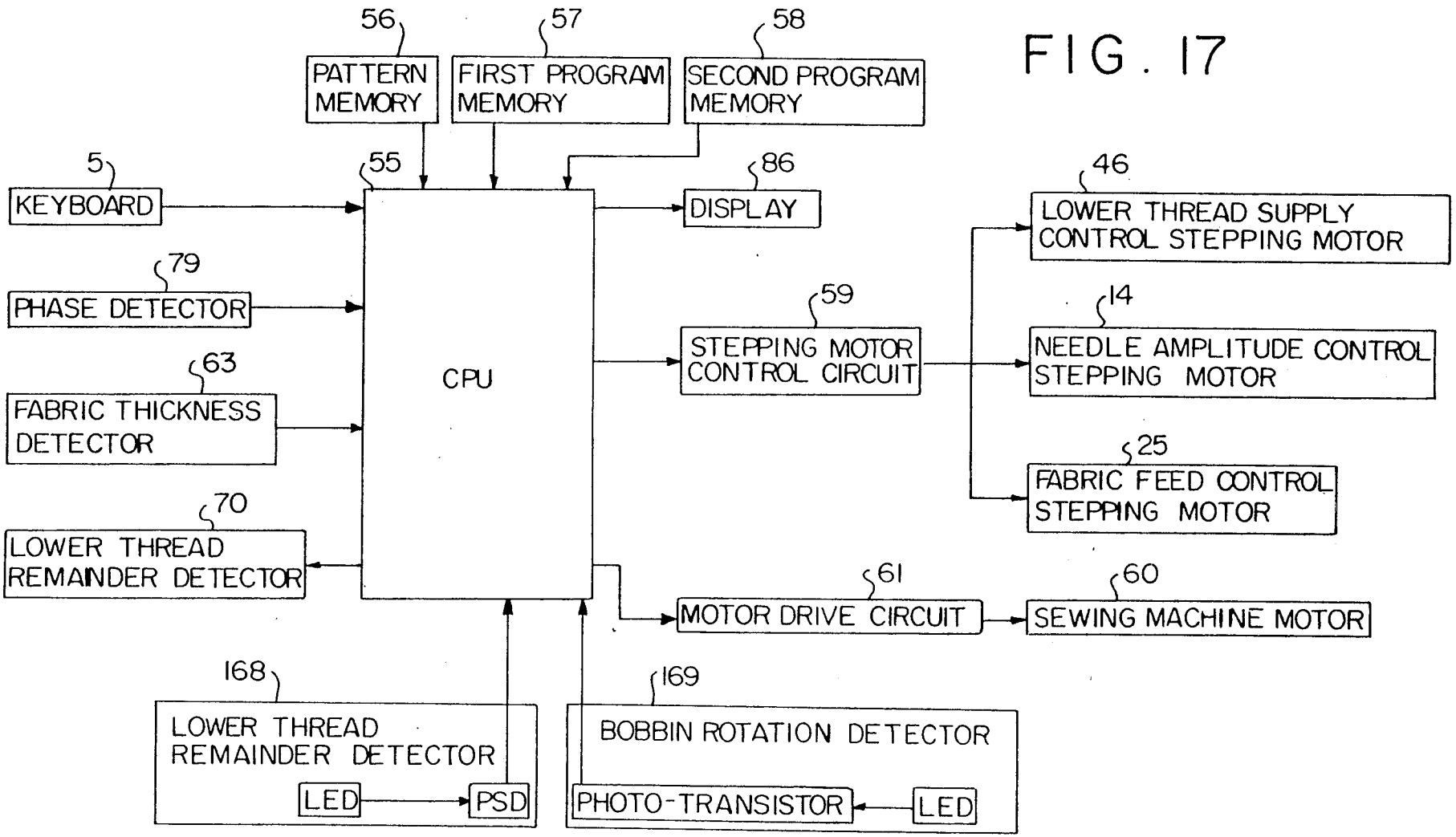
FIG. 17 is a block diagram showing control operation of the modified embodiment in FIGS. 15 and 16.

In the foregoing embodiment, the same arrangement typically consisting of LED 47 and PSD 48 will serve both as the lower thread remainder detector 68 and the bobbin rotation detector 69. However, these detector means may be arranged separately as shown in FIGS. 15 through 17, by way of example. In these drawings, the members and elements identical to those in the first embodiment are accompanied by identical reference numerals.

A light emitting element such as an LED 49 is attached on the backside of the needle plate 18 for emitting a light toward one of semicircular portions of the upper brim of the bobbin 33. To the said semicircular portion is attached an elongated reflector plate **133*b* extending substantially in a radial direction, which reflects the light projected from LED 49 to be received by a light receiving element such as a photo-transistor 50 which is also attached on the backside of the needle plate 18 in vicinity to LED 49. Each rotation of the bobbin 33 may be detected upon each receiving of the light by the photo-transistor 50. The photo-transistor 50 will intermittently receive the light reflected from the reflector plate 133*b* to output a pulse signal. Such arrangement will easily be understood to serve as the bobbin rotation detector 169, like the detector 69** in the first embodiment.

The lower thread remainder detector 168 employed in this embodiment will substantially identical to that used in the first embodiment. LED 47 secured to the backside of the needle plate 18 for emitting the light toward PSD 48 through the transparent portions of the lower brim **33*a* (FIGS. 7 and 8) of the bobbin 33 and through an arcuate transparent plate 128*b* fitted in the bottom of the loop-taker 28. In this case, the transparent plate 128*b* may only extend over the semicircle of the bottom, as best seen in FIG. 16. The detection signal is outputted from PSD 48 to CPU 55**. The control operation of this embodiment will be apparent from the block diagram of FIG. 17, which will be carried out in the same manner as in the first embodiment.

Figure 20:
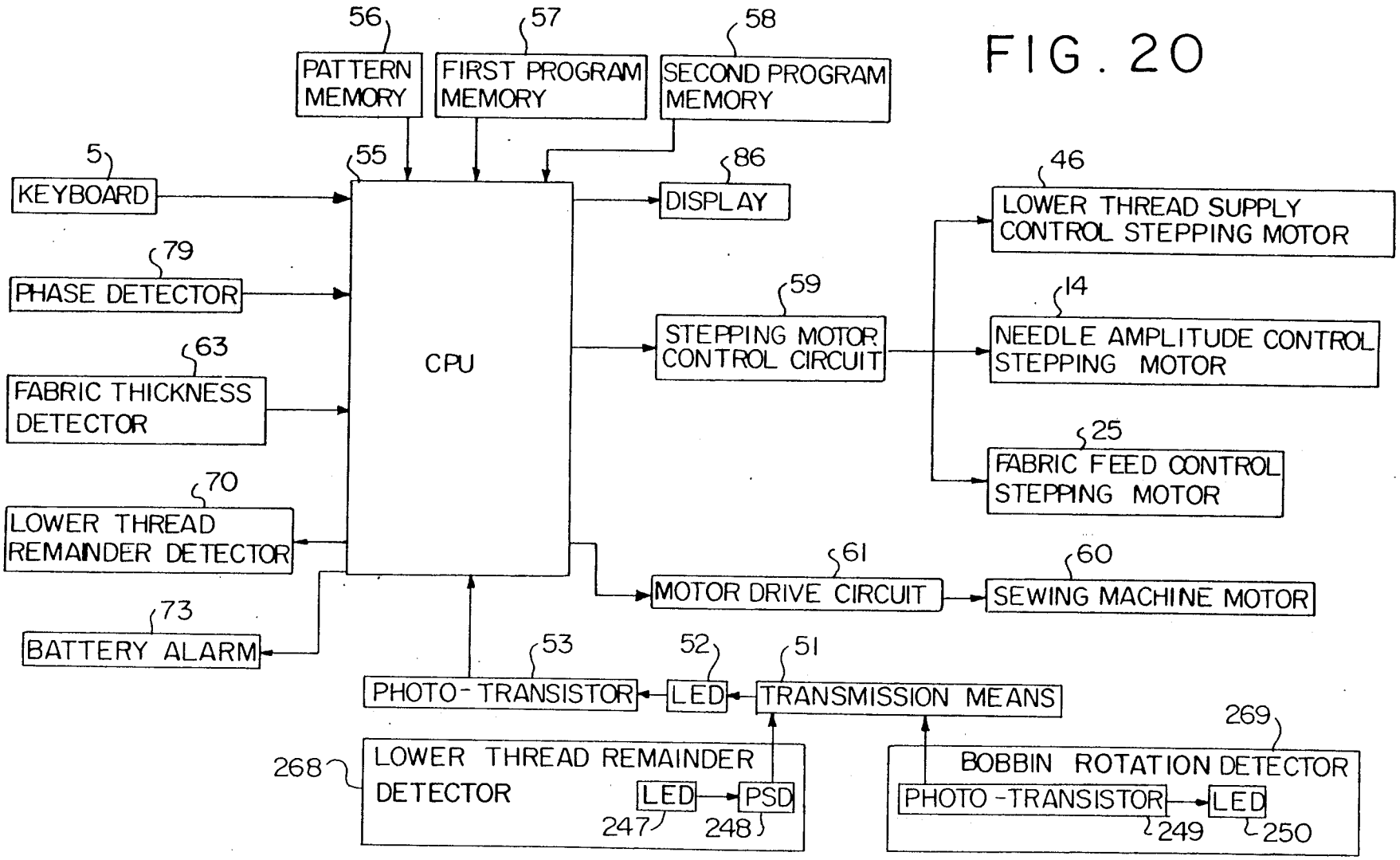
FIG. 20 is a block diagram showing control and operation of the still modified embodiment shown in FIGS. 18 and 19.

A still modified embodiment is illustrated in FIGS. 18 through 20. In this embodiment, a circuit base 71 for mounting thereof control circuits (not shown) is disposed within the bobbin case 34. The circuit base 71 is made of an insulating resin material. The bobbin 33 is rotatably supported on the circuit base 71. A light receiving element such as a PSD 248 is mounted on the circuit base 71 in an opposed relationship with respect to a light emitting element such as an LED 247 attached to the backside of the needle plate 18. LED 247 and PSD 248 cooperates with each other to serve as the lower thread remainder detector 268 substantially in the same manner as in the first and second embodiments.

Another light emitting element such as an LED 249 is secured on the circuit base 71, which cooperates with a light receiving element such as a photo-transistor 250 which is also mounted on the circuit base in vicinity to LED 249. An elongated reflector 233*b* extending in a radial direction is secured to the backside of the lower brim of the bobbin 33. The light emitted from LED 249 will be reflected by the reflector 233*b* to be received by the photo-transistor 250 at each specific angular position of the bobbin 33 during rotation thereof. The photo-transistor 250 outputs a pulse signal in response to detection of the reflected light. The bobbin rotation detector 269 in this embodiment is composed of these elements.

A transmission means 51 on the circuit base 71 is connected to PSD 248 of the lower thread remainder detector 268 as well as to the photo-transistor 250 of the bobbin rotation detector 269. In response to the voltage change signal supplied from PSD 248 and the pulse signals supplied from the photo-transistor 250, the transmission means 51 will generate a transmittable output signal composed of these input signals. The output signal may be divided into two sections, one corresponding to the lower thread remainder detection signal being transmitted between the rotational phase of the main drive shaft of 0° and 180° and the other corresponding to the bobbin rotation detection signal being transmitted between the rotational phases of 180° and 360° (0°).

The transmission means 51 will supply the output signal to a transmitting element such as an LED 52 secured to the backside of the circuit base 71 at a position aligned with the axis of rotation of a stationary shaft 282. LED 52 converts the output signal to a flashing signal, for example, which may be transmitted through a window 234 formed in the bobbin case 34 and a hollow space of the shaft 282, to be received at last by a light receiving element such as a photo-transistor 53 mounted on the machine housing 1.

A storage battery 54 is exchangeably fitted on the circuit base 71 for supplying a power to the transmission means 51 and the light emitting and receiving elements 247 to 250. A voltage of the battery 54 is continuously detected so that when the voltage becomes lower than a predetermined level, a voltage alarm means comprising an LED 73 is made operative to call the operator's attention to exchange the battery 54.

Control operation of the sewing machine in accordance with this embodiment will be understood from the block diagram of FIG. 20. The detection signals outputted from the detectors 268 and 269 respectively are incorporated into the output signal transmittable by the transmission means 51 which drives the transmitting element LED 52. The light signal from LED 52 is received by the photo-transistor 53 and the results will then be processed by CPU 55. Thus, CPU 55 calculates the actual lower thread supplying amount in the same manner as described in connection with the first embodiment. Also, CPU 55 make operative the alarm means 270 when the lower thread remainder in the bobbin should be lower than the prescribed limit. LED 73 will give warning of the battery 54 to be exchanged.

Means for supplying a power to the photoelectric elements will not be limited to the storage battery 54. For example, as shown in FIGS. 21 and 22, a solar battery 354 provided at the backside with photo-sensitive section is attached to the bottom of the bobbin case 34. An LED 376 is secured to the attachment plate 84 for emitting a light toward the photo-sensitive section of the solar battery 354 through an annular opening 328*b* formed in the bottom of the loop-taker 28.

FIGS. 23 and 24 illustrate another arrangement for transmission of the light signal. The transmittable output signal processed by the transmission means 51 is supplied to a light emitting element such as an LED 452 which is positioned offset with respect to the axis of rotation of a shaft 482 which may not include a bertically extending hollow space as in the shaft 282. The light signal outputted from LED 452 passes through a semi-annular groove 428*b* formed in the bottom of the loop-taker 28 and then is received by a photo-transistor 453 mounted on the attachment plate 84. The results of detection for the lower thread remainder and the bobbin rotation will be given to CPU 55 during each half rotation of the loop-taker 28, that is of the main drive shaft 2.

Although the invention has been described in conjunction with specific embodiments thereof, it is to be understood that many variations and modifications may be made without departing from spirit and scope of the invention as defined in the appended claims.

What is claimed is:

1. A sewing machine having a vertically reciprocating needle carrying an upper thread; a rotatable bobbin carrying a lower thread; and a loop-taker means operated in synchronism with reciprocation of the needle to interlock the upper thread with the lower thread to form a stitch; which further comprises a memory means for storing stitch control data of a plurality of patterns which may be produced with the sewing machine; a calculation means for theoretically determining an amount of the lower thread to be supplied from the bobbin in formation of each stitch, based on the stitch control data of a specific pattern to be produced; a detection means for detecting a practical amount of the lower thread which has actually been supplied from the bobbin in formation of each stitch; and a control means for comparing said theoretical lower thread amount determined by said calculation means and said practical lower thread amount determined by said detection means to thereby calculate a correction coefficient to be used for correcting said theoretical lower thread amount of the lower thread in a controlled manner to an optimum amount by which the lower thread is supplied from the bobbin to produce the next stitch.

2. A sewing machine comprising a vertically reciprocating needle carrying an upper thread; a rotatable bobbin carrying a lower thread; a loop-taker means operated in synchronism with reciprocation of said needle to interlock the upper thread with the lower thread to form a stitch; a lower thread supplying means for supplying the lower thread from said bobbin to said loop-taker means; a detection means for detecting an actual lower thread amount supplied in each stitch forming operation; a pattern memory means for storing stitch control data of a plurality of patterns which may be produced with the sewing machine; a select means for selecting one of the patterns to read out said stitch control data thereof from said memory means; a first program memory for storing a first program; a second program memory for storing a second program; and a control means for actuating said lower thread supplying means to supply an optimum amount of the lower thread in each stitch forming operation, said control means being operated such that (i) said stitch control data of the selected pattern is processed in accordance with said first program to determine on a theoretical basis a lower thread amount necessary for producing one stitch of the selected pattern, (ii) said theoretical lower thread amount is compared with the actual lower thread amount detected by said detection means in formation of said one stitch, to thereby calculate a correction coefficient in accordance with said second program, and (iii) the theoretical lower thread amount for the next stitch is corrected with said correction coefficient to determine said optimum amount of the lower thread by which the lower thread is supplied by said lower thread supplying means for producing the said next stitch.

* * * * *